US005137367A

United States Patent [19]

Madonia et al.

[11] Patent Number: 5,137,367

[45] Date of Patent: Aug. 11, 1992

[54] AUTOMATED PAINT PRODUCTION APPARATUS

[75] Inventors: Kenneth J. Madonia, Murrysville, Pa.; Niles M. Dwyer, Park Ridge, Ill.

[73] Assignee: Fluid Management Limited Partnership, Wheeling, Ill.

[21] Appl. No.: 590,242

[22] Filed: Sep. 28, 1990

[51] Int. Cl.[5] ..... B01F 11/00

[52] U.S. Cl. ..... 366/218; 366/605

[58] Field of Search ..... 366/605, 208, 209, 210, 366/211, 212, 216, 218, 197, 202, 203; 198/442

[56] References Cited

U.S. PATENT DOCUMENTS

| | | | |
|---|---|---|---|
| 2,036,421 | 4/1936 | Luckie | 198/442 |
| 2,542,451 | 2/1950 | Anderson et al. | 366/218 |
| 3,462,912 | 7/1967 | Anderson | 198/442 |
| 3,848,394 | 11/1974 | Heisler | 198/442 |

*Primary Examiner*—Harvey C. Hornsby

*Assistant Examiner*—Reginald L. Alexander

*Attorney, Agent, or Firm*—Fitch, Even, Tabin & Flannery

[57] ABSTRACT

An automated apparatus for mixing ingredients stored in closed containers includes two or more mixing mechanisms. A diverter gate upstream of the mixing mechanisms guides containers to one or the other mechanism, as desired. Powered conveyors move the containers past the diverter gate and retractable pusher arm assemblies load the containers onto the mixing mechanisms. After a mixing operation is completed, the pusher arm assemblies discharge the containers onto an exit conveyor for transport to a remote packaging station. Sensors are disposed along the path of travel of the pusher arm assemblies to control operation thereof, providing a ready indication that a container is properly positioned on a mixing mechanism, and that the mixing operation can be initiated.

18 Claims, 6 Drawing Sheets

AUTOMATED PAINT PRODUCTION APPARATUS

BACKGROUND OF THE INVENTION

1. Field of the Invention

The present invention pertains to apparatus for the automated production of paint and other materials which are dispensed into a container, and with closure of the container are mixed by agitating the container.

2. Description of the Related Art

Products which are composed of several ingredients are often produced by combining ingredients in a shipping or storage container, sealing the container and then mixing the contents thereof. For example, pulverulant products such as cement mixes or liquid products such as paints and coatings are readily amenable to such production techniques. In the paint industry, for example, a can, pail or other suitable container is filled with a base material. The containers may have a five gallon or a one gallon capacity, for example. Thereafter, one or more tinting agents are injected or otherwise added to the base material.

A paint base material may be tinted at a local business establishment conveniently accessible to an end user, using materials provided by a paint manufacturer. The tinting agents and possibly other additives are added to a paint base material, and the container is then sealed and inserted into a mixing apparatus which shakes or otherwise moves the container to mix the contents thereof. It is important that the ingredients of a paint formulation be thoroughly mixed to provide a uniform color value throughout the container contents. Such mixing may be performed, for example, by bench top units or, less commonly, by floor mounted units both of which are manually operated by store personnel who insure that the container is securely clamped within the mixing apparatus, and who set the desired amount of time for a mixing operation. At the end of the mixing cycle, the operator unclamps the container from the apparatus and presents the container to the end user, with no further operations being required in most cases.

Paint is also manufactured by tinting a base material in a mass production facility. Such "factory formulations" are important, for example, when large quantities of a formulated paint are required, or when certain quality controls are required, especially for unusual paint formulations. Also, depending upon the distribution system available and other factors, additional economies of production are possible only with large-scale factory operations. United States patent application Ser. No. 432,991, filed Nov. 6, 1989, the disclosure of which is incorporated in this application as if fully set forth herein, describes a commercial scale paint production facility in which paint is dispensed in batches to achieve various advantages, such as improved quality control over the paint formulation on an individual container basis, and for reduced waste of the paint materials which are used in the course of a production run.

Further advantages are obtained in such mass production facilities since the entire operation can be fully automated. For example, the containers may be provided with bar-code indicia which contain paint formulation and other information such as the size of the container and customer information associated with an order for the paint material. In order to preserve the economies of a fully automated paint production facility, an automated mixing of the containers at a rate consistent with commercial production operations, is required.

Examples of manually operated mixing equipment are given in U.S. Pat. No. 4,134,689 and United States Design Pat. No. 254,973. In these patents a floor mounted machine is provided for receiving a container to be mixed. An operator adjusts a motor-operated clamping mechanism to insure an adequate clamping force is applied to the container. Next, the operator initiates a mixing cycle and thereafter unclamps and removes the container from the apparatus.

SUMMARY OF THE INVENTION

It is an object according to the present invention to provide an automated mixing apparatus for containers carrying pulverulant or liquid materials.

Another object according to the present invention is to provide automated mixing apparatus which can receive a series of containers from a conveyor line.

A further object according to the present invention is to provide automated mixing apparatus which mixes the contents of several containers at one time.

A further object according to the present invention is to provide multiple mixing facilities at a mixing station, along with means for routing the containers to one facility or the other.

These and other objects according to the present invention which will become apparent from studying the appended description and drawings are provided in an automated apparatus for mixing ingredients stored in closed containers, comprising:

- an input support surface for receiving a series of containers from an inlet conveyor;
- an output support surface for discharging containers to an exit conveyor;
- at least two processing lanes between the input and output support surfaces for transporting containers therebetween;
- lane guide means between said input support surface and said processing lanes, selectably movable to selectably guide containers carried by said input support surface to a particular processing lane for mixing thereat;
- at least one mixing station in each processing lane, each mixing station including a frame means for movably supporting a container for movement in a mixing motion, container clamping means for selectably clamping the container within said frame means to maintain engagement therewith during a mixing operation, and drive means for moving said frame means with a mixing motion so as to agitate the contents of a container clamped therein; and
- loading means in each processing lane for loading a container guided by said lane guide means in the frame means.

Other objects according to the present invention are obtained in an automated apparatus for use in an automated production facility to mix ingredients stored in a series of closed containers, comprising:

- inlet conveyor means;
- an input support surface for receiving a series of containers from inlet conveyor means;
- outlet conveyor means;
- an output support surface for discharging containers to the outlet conveyor means;
- at least two processing lanes between the input and output support surfaces for transporting containers therebetween;

lane guide means between said input support surface and said processing lanes, selectably movable to selectably guide containers carried by said input support surface to a particular processing lane for mixing thereat;

at least one mixing station in each processing lane, each mixing station including a frame means for movably supporting a container for movement in a mixing motion, container clamping means for selectably clamping the container within said frame means to maintain engagement therewith during a mixing operation, and drive means for moving said frame means with a mixing motion so as to agitate the contents of a container clamped therein; and loading means in each processing lane for loading a container guided by said lane guide means in the frame means.

BRIEF DESCRIPTION OF THE DRAWINGS

In the drawings, wherein like elements are referenced alike.

DETAILED DESCRIPTION OF THE PREFERRED EMBODIMENT

Figure 1:
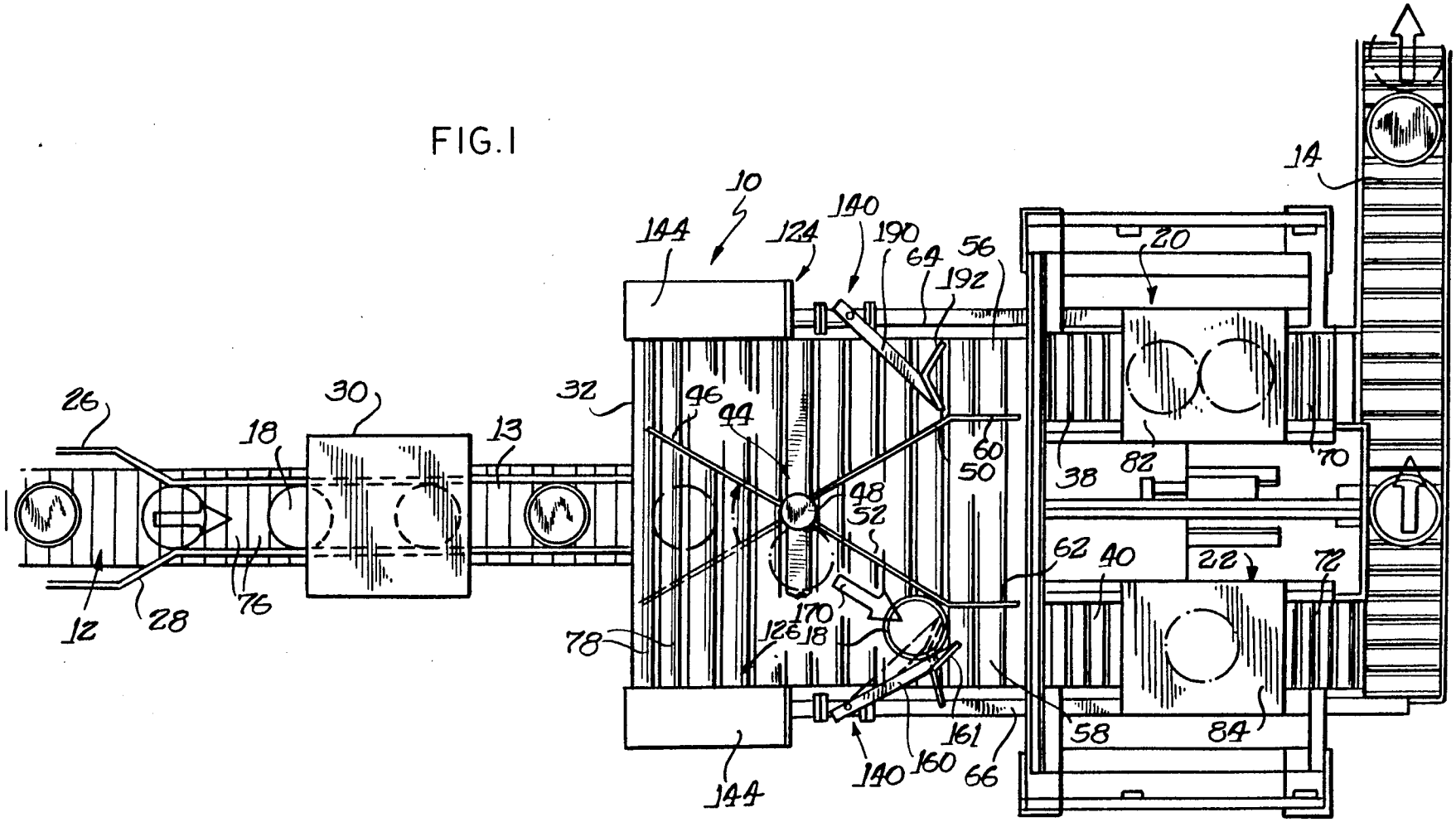
FIG. 1 is a top plan view of an automatic mixing station illustrating principles according to the present invention.

Referring now to the drawings, and initially to FIG. 1, an automatic mixing station according to principles of the present invention is generally indicated at 10. The mixing station 10 includes an inlet conveyor 12 and an exit conveyor 14. A series of containers 18 holding contents to be mixed are introduced to the mixing station by conveyor 12, and are directed, either individually, in pairs, or four at a time to one of two mixing mechanisms 20, 22. The containers, after being mixed, are passed to exit conveyor 14 where they continue on in the production cycle.

The present invention may be used to mix a variety of materials which are packaged in closed containers, ready for shipment to an end user. The present invention may be used, for example, with liquid products, mixtures of liquid and pulverulant products, such as block fillers, and with pulverulant products such as cement mixes. In the preferred embodiment, the present invention finds immediate application in an automated paint manufacturing facility wherein one or more colorants are added to a paint base, the ingredients of a paint formulation being introduced directly into containers 18.

After the ingredients of the paint formulation are added, the containers are sealed at a lidding station 30 located upstream of mixing station 10 where the containers are sealed, preparatory to the mixing operation. The sealed containers enter an input support surface 13 of restricted width which accurately positions the containers with respect to the mixing apparatus. The sealed containers then enter a wider, intermediate conveyor 32. As can be seen in FIG. 1, the intermediate conveyor 32 is several times wider than the feed conveyor 12 or support surface 13, the conveyor 32 spanning the entrance conveyors 38, 40 associated with mixing mechanisms 20, 22, respectively.

Located in an upstream portion of conveyor 32 is a lane guide mechanism or diverter generally indicated at 44. The diverter includes a gate 46 pivotally mounted at 48 to a drive mechanism, as will be explained with reference to FIG. 2. The gate 46 is moveable between the two positions illustrated in FIG. 1, one position illustrated in solid lines, the other illustrated in phantom. The diverter gate 46 guides containers 18 along one of two processing lanes or product paths, each associated with one of the two mixing mechanisms. A pair of diverging guide walls 50, 52 are located immediately downstream of diverter 44, and terminate at chutes 56, 58, respectively, formed by wall portions 60, 62 which are aligned generally parallel to outer rails 64, 66 located at lateral edges of conveyor 32. The chutes 56, 58 are aligned with the entrance conveyors 38, 40 which together cooperate to align containers 18 in the mixing mechanisms 20, 22. Output support surfaces 70,72 formed of static rollers are located between the mixing mechanisms 20, 22 and exit conveyor 14. If desired, the rollers of the output support surfaces may be power driven to assist the discharge of the containers.

Figure 2:
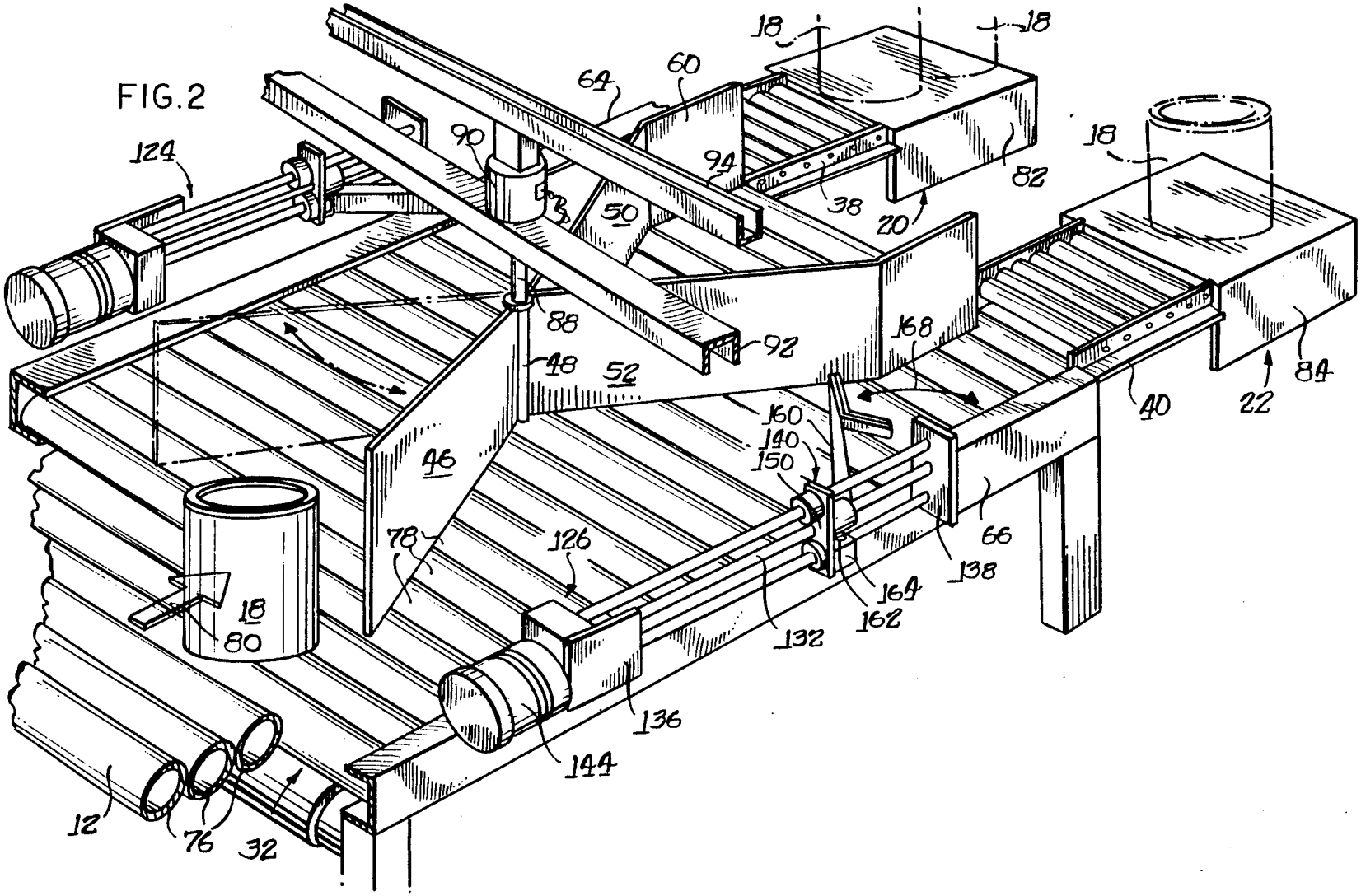
FIG. 2 is an enlarged, fragmentary perspective view of the paint mixing apparatus of FIG. 1.

Referring now to FIG. 2, input support surface 13 is shown comprising a series of rollers 76 which are aligned coplanar with the rollers 78 of conveyor 32, and which are also aligned with the inlet conveyor 12. In the Preferred Embodiment, the rollers 76, 78 are power driven by a belt 79 (see FIG. 3). The belt travels in the direction of arrow 81, so as to transport containers 18 in the downstream direction of arrow 80. As can be seen in FIG. 2, the conveyors 38, 40 are also comprised of a series of laterally extending rollers, aligned coplanar with the tables 82, 84 of mixing mechanisms 20, 22, respectively (see FIG. 1). However, the rollers of conveyors 38, 40 are not powered (and are thus unlike the other conveyor sections), so as to stop the containers at a defined location, in preparation for engagement with the shuttle arm.

Referring again to FIG. 2, gate 46 is secured at one end to pivot support 48 which includes a shaft 88 extending to an electric motor operator 90, supported above conveyor 32 by lateral channels 92, 94. Motor 90 may either comprise a stepper motor or may include mechanical gearing at its output shaft so as to rotate shaft 88 a predetermined amount, moving gate 46 between the two positions indicated in FIGS. 1 and 2. For example, as illustrated in FIG. 2, gate 46 is swung in a counterclockwise direction (as viewed from a point above conveyor 32), directing containers 18 toward mixing mechanism 20 and onto the table 82 thereof.

Rollers 78 are preferably power driven moving container 18 in the downstream direction of arrow 80. The rails 26, align the containers along a center line of conveyor 32. With continued movement, container 18 contacts gate 46 and slides along the gate, being guided thereby. The container continues its downstream travel, passing along wall 50, entering an area of the mixing station where feed mechanisms, one for each product path, aid in propelling the container toward the mixing mechanism, as will be explained below. On command, motor 90 is rotated in an opposite direction, moving gate 46 to the position indicated in phantom in FIG. 2, ready to guide containers 18 to the other mixing mechanism 22, and onto the table 84 thereof.

Figure 3:
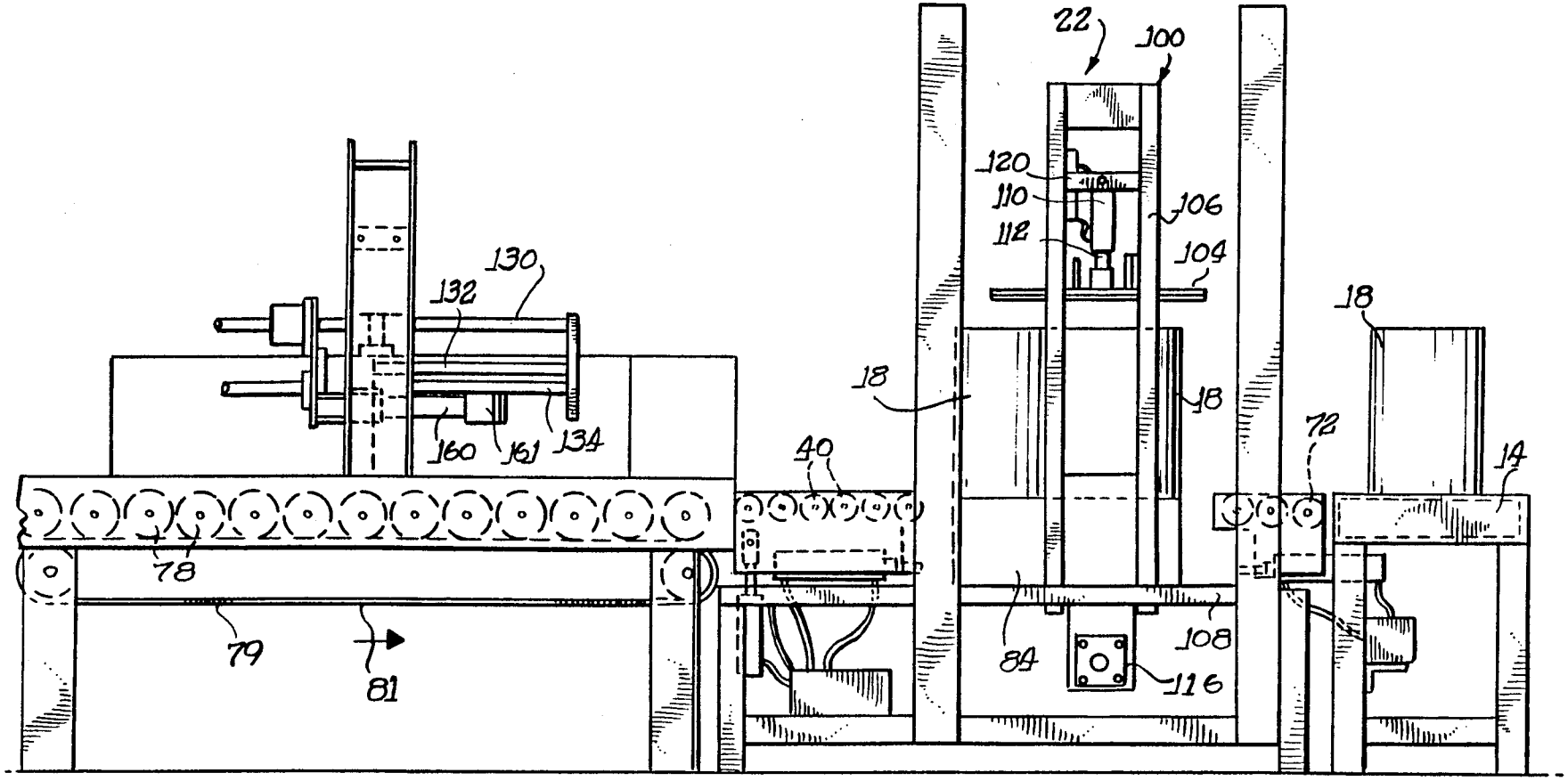
FIG. 3 is a side elevational view of the automatic mixing station of FIG. 1.
Figure 8:
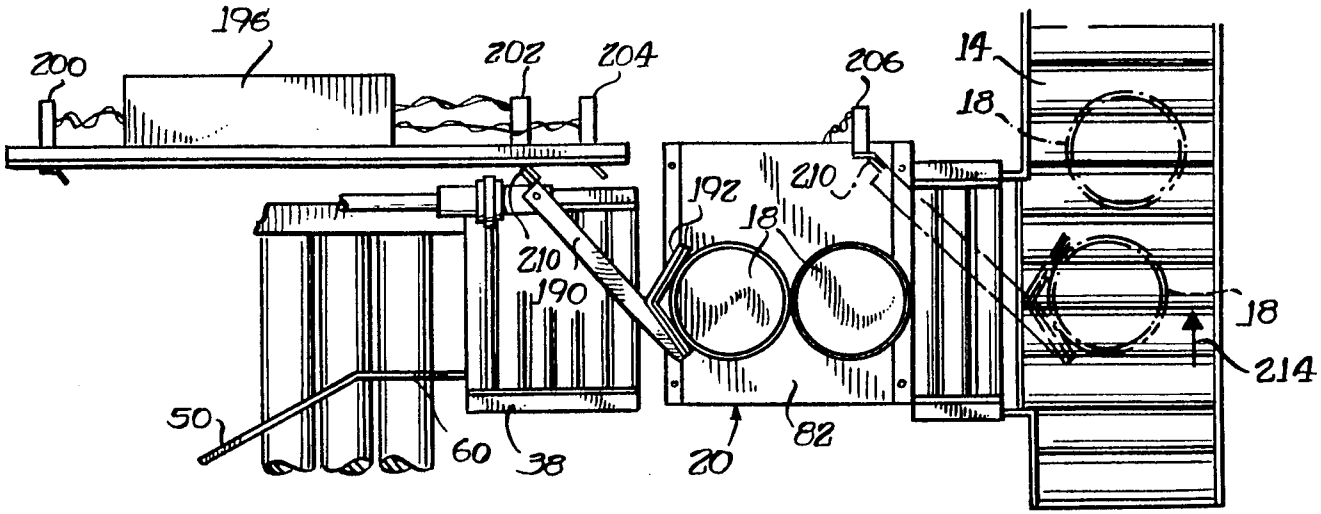
FIG. 8 is a fragmentary plan view showing a loading of two containers on the mixing apparatus.

As illustrated in FIGS. 2 and 3, the mixing apparatus according to the present invention can accommodate multiple containers (preferably either two or four) at a mixing station. For example, FIG. 8 illustrates two containers in position at mixing station 20. The containers are mixed simultaneously, and are thereafter discharged to exit conveyor 14.

Referring to FIG. 3, the mixing stations 20 and 22 include a mixing mechanism 100 consisting of a moveable platform, such as the platform 84, and an upper pressure plate 104 which clamps the containers 18 in position on the moveable table, maintaining the containers captive during a mixing operation. Framework 106 for the clamping plate is mounted at its lower end to table 108 which provides a convenient mounting for the mixing apparatus and the entrance conveyor 40. An hydraulic cylinder 110 extends in a downward direction, having a base secured to framework 106 and a piston 112 connected to pressure plate 104.

When containers 18 are moved in position on table 84, hydraulic cylinder 110 is pressurized to extend plate 104 to its lowered, clamping position, in engagement with one or more containers 18. An electric motor 116 is mounted to table 108 and has an output shaft connected to mechanism, not shown, for moving table 84 in an orbital path. The hydraulic cylinder 110 is pinned at 120 to frame 106, and piston 112 is connected with a swivel mounting to plate 104, to follow the orbital motion. The motor and mixing mechanism is adapted from a Model 5G mixer, Part No. 12147 available from Miller Limited Partnership of Addison, Ill. The mixer, marketed for use in a manual operation, was adapted for the fully automatic operation described herein, the frame 106 and clamping plate 104 being added thereto, for example. At the end of a mixing operation, the piston 112 is retracted by hydraulic cylinder 110 to release clamping plate 104. The containers are then discharged to conveyor 14.

Referring now to FIGS. 2–7, the mixing apparatus 10 includes a pair of assemblies, generally indicated at 124, 126, located on opposite sides of intermediate conveyor 32. The assemblies 124, 126 are mirror images of one another, being comprised of similar parts except for the oppositely directed shuttle arms.

Figure 6:
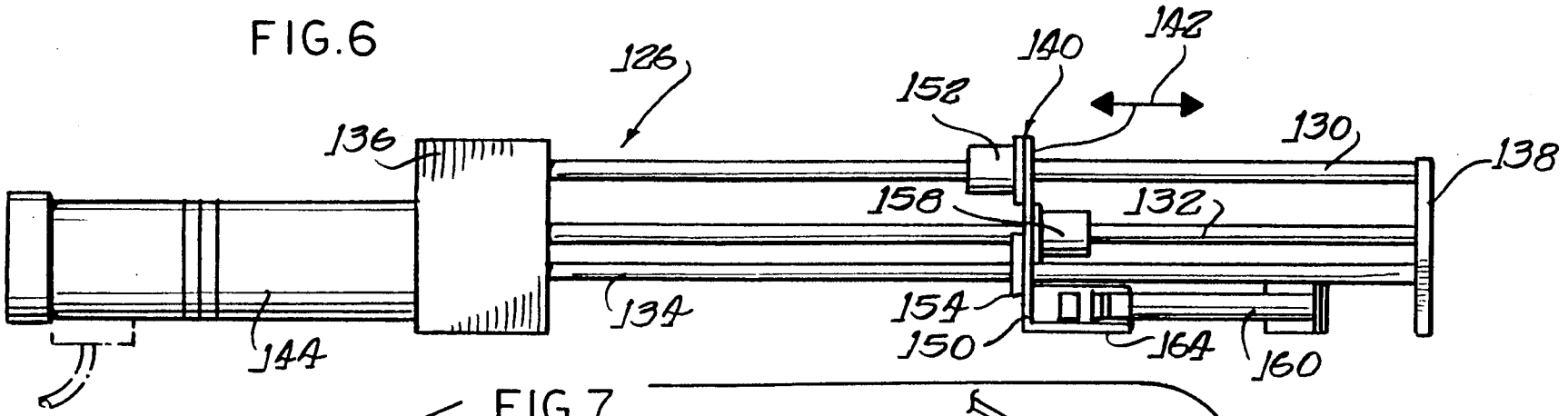
FIG. 6 is a fragmentary side elevational view of the mixing apparatus showing a shuttle arm assembly thereof.
Figure 7:
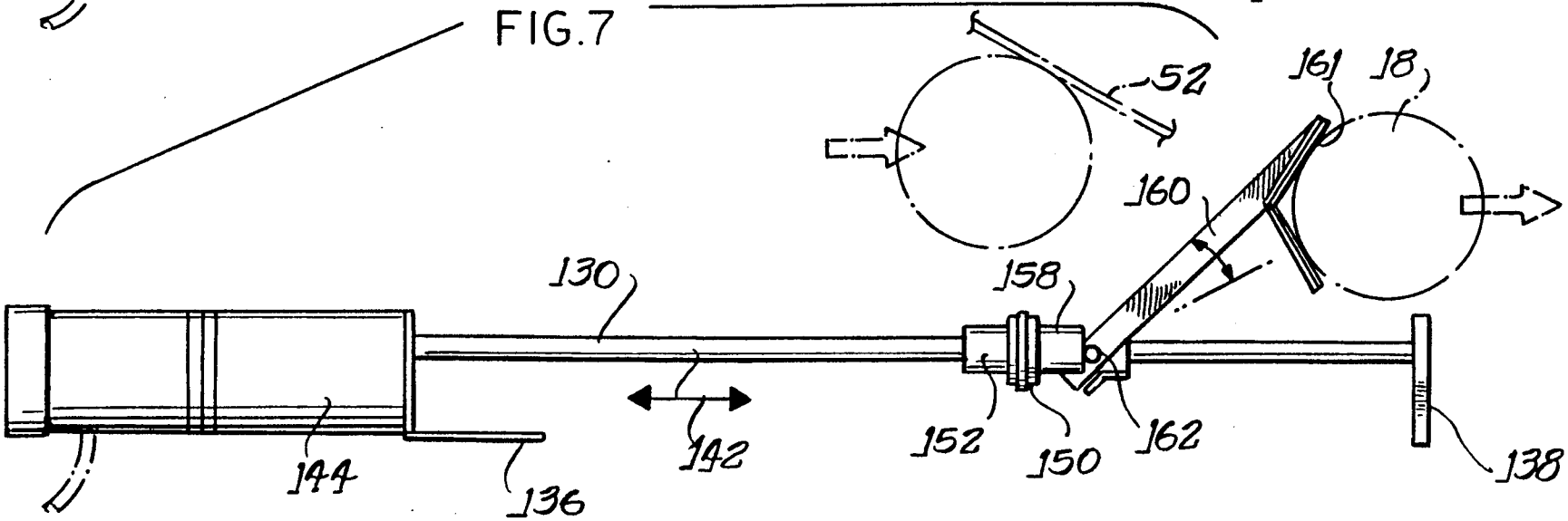
FIG. 7 is a fragmentary plan view of the shuttle arm assembly of FIG. 6.

Referring to FIGS. 2, 6 and 7, shuttle arm assembly 126 includes a pair of guide rails 130, 134 and an intermediate screw shaft 132. A shuttle generally indicated at 140 travels along the guide rails, being reciprocated back and forth in the direction of arrow 142 as shaft 132 is rotated. Shaft 132 is driven by an electric motor 144 mounted to support 136. Motor 144 preferably comprises a stepper motor, although other motors having a controlled operation may also be used.

Shuttle 140 includes a body with a vertical plate 150 and slide bushings 152, 154 which engage guide bars 130, 134. A threaded bushing 158 engages threaded shaft 132 and converts the rotation of the shaft to a linear displacement in the directions of arrow 142. A retractable shuttle arm 160 is pinned at 162 to a support leg 164 secured to the lower end of vertical plate 150. The shuttle arm 160 is free to pivot in the direction of arrow 168 (see FIG. 2). The arm 160 is biased toward its undeflected position, illustrated in phantom in FIG. 1 and, also in FIGS. 4 and 6.

Referring to FIG. 1, the shuttle 140 is advanced toward drive motor 144 so as to move shuttle arm 160 to a retracted position, with the V-shaped contact member 161 in the path of travel of container 18 which is advanced along the guide wall. As the container contacts shuttle arm 160, the arm is deflected toward the support rail assembly in the manner indicated in FIG. 1, allowing the passage of container 18 past the shuttle arm. The power-driven rollers 78 of intermediate conveyor 32 continue to advance container 18 in a downstream direction of arrow 170, clearing the contact member and thus allowing the shuttle arm 160 to return to its undeflected position, illustrated in phantom in FIG. 1. The container 18 continues to travel in the downstream direction, being guided by wall 62 until it reaches the last power driven roller 78 of intermediate conveyor 32, at the upstream end of the static entrance conveyor 40.

Figure 4:
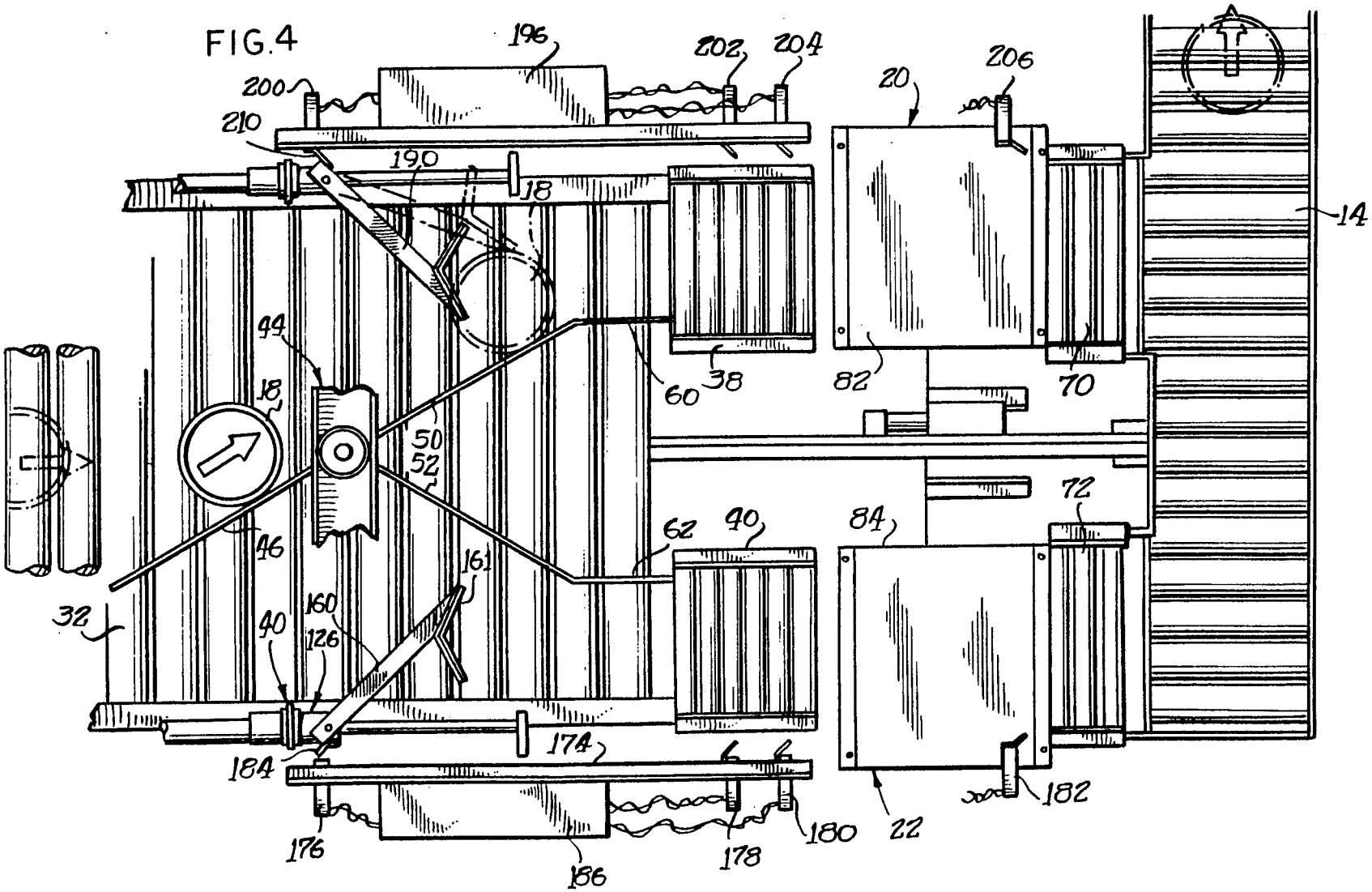
FIG. 4 is a fragmentary plan view of the automatic mixing station of FIG. 1, shown on an enlarged scale.

Turning now to FIG. 4, a plurality of sensors are disposed adjacent the product path, so as to monitor the position of shuttle arm 160 therealong. The sensors are mounted on a support 174 extending along one side of intermediate conveyor 32. A first sensor 176 is located at an upstream position, second and third sensors 178, 180 are located at intermediate positions, and an optional (associated with container ejection) sensor 182 is located at a downstream position. A projection 184 of ferrous material extends from one end of shuttle arm 160, so as to be placed in close proximity to the sensors 176–182 as the arm travels throughout its range of motion.

For example, with arm 160 located at its retracted position illustrated in FIG. 4, projection 184 is located proximate to sensor 176, sending an electrical signal to control unit 186, advising control circuitry therein of the position of the shuttle arm. When a single container 18 is to be mixed at station 22, the shuttle 140 is allowed to travel along threaded rod 132 until projection 184 (carried on arm 160) is sensed at sensor 180. The control circuitry in control unit 186, responding to signals from sensor 180, reverses the direction of shuttle movement, causing the shuttle and the shuttle arm 160 to move to the upstream, retracted position. Sensor 180 is located a precise distance upstream of table 84 such that a container 18 is centered on table 84 when projection 184 is detected at sensor 180, the container being moved to the position as illustrated in FIG. 1.

As mentioned, it is possible to mix more than one container at one time, in either station 20 or 22. The intermediate sensor 178 is used when two or more containers are loaded at entrance conveyor 40, the shuttle arm 160 pushing both containers into position on moveable table 84, the arm being stopped when projection 184 is detected at sensor 178. A similar positioning is illustrated in FIG. 1 at station 20.

In the Preferred Embodiment, the guide rails extend past the mixing mechanisms to a point adjacent exit conveyor 14. This extension which may be omitted if desired, cooperates with sensor 182 to provide an ejection of containers at the mixing mechanism.

After a mixing operation is completed, threaded shaft 132 is rotated to move shuttle 140 past the mixing mechanism 84, to its fully extended position, detected when projection 184 is sensed at downstream sensor 182, the shuttle arm 160 being positioned such that the contact member 161 thereof overlies conveyor 14. The aforedescribed operation will become apparent from the following description of the mirror image apparatus associated with mixing station 20.

Referring now to FIG. 1, the shuttle arm assembly 124 is substantially identical to the aforedescribed shuttle arm assembly 126, except that the V-shaped contact member of 192 shuttle arm 190 opens in an opposite direction from the aforedescribed contact member 161, generally comprising a mirror image thereof. The motor, guide rails and shuttle assembly are the same as those used in shuttle arm assembly 126.

As illustrated in FIGS. 1 and 8, a pair of containers 18 are loaded onto the table 82 of mixing station 20. Referring to FIG. 4, a container 18 is deflected by gate 46, and travels along guide walls 50, 60. A shuttle arm 190 is immediately moved to its fully retracted position, opposite guide wall 50. As the container passes shuttle arm 190, the arm is retracted to allow the container to pass the arm, toward its temporary resting position at the upstream end of entrance conveyor 38.

Figure 5:
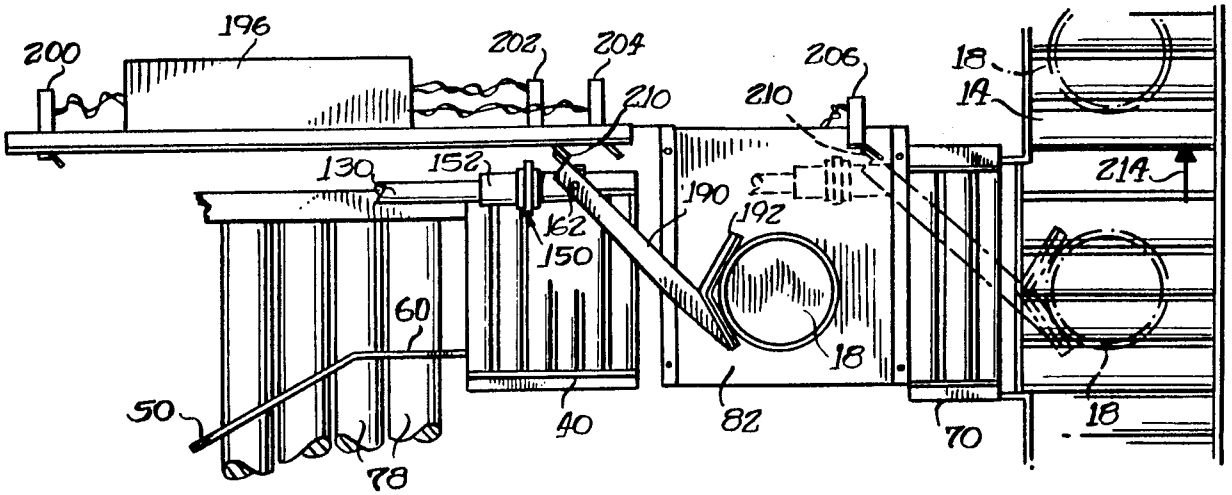
FIG. 5 is a fragmentary plan view of the automatic mixing station of FIG. 1.

With reference to FIG. 5, the drive motor is activated by control circuit 196 which receives signals from a series of sensors 200–206. Signals from sensor 200 indicate that a projection 210 carried by shuttle arm 190 is located proximate the sensor 200, with the arm being located at a fully retracted position. As the motor is energized, the threaded shaft moves shuttle arm 190 in the downstream direction toward table 82. As the contact member 192 carried on arm 190 approaches entrance conveyor 40, it engages a container 18. With continued travel of arm 190, the container is pushed onto table 82, as illustrated in FIG. 5. As sensor 202 detects the presence of projection 210, further travel of the arm is stopped, and the motor is reversed to retract the shuttle arm away from table 82. Thereafter, the clamping plate at mixer station 82 is lowered and table 82 is driven with an orbital motion, mixing the contents of container 18 loaded thereon.

When the mixing operation is completed, the pressure plate is raised and the shuttle arm 190 is again advanced in a downstream direction, through the position illustrated in FIG. 5. In the container ejection operation, the shuttle arm 190 is further advanced in a downstream direction along an extended guide rail to the position illustrated in phantom in FIG. 5, with the presence of projection 210 being detected by sensor 206. Signals from sensor 206 cause control unit 196 to respond by reversing the direction of motor 144, moving shuttle arm 190 to the fully retracted position illustrated in FIG. 1, ready for another operation. As the shuttle arm 190 is retracted, and the contact member 192 is withdrawn away from container 18, and the container is free to move in the downstream direction of arrow 214.

With reference to FIG. 8, two containers may be mixed at station 20, at one time. The gate 46 is maintained in the position illustrated in FIG. 4, after a first container arrives at entrance conveyor 38, the second container travelling in the same direction illustrated in FIG. 4. When the second container has advanced to the end of intermediate conveyor 32, control unit 196 energizes motor 144 to move shuttle arm to the position illustrated in FIG. 8, with projection 210 being moved proximate to sensor 202. Signals from sensor 202 received by control unit 196 cause motor 144 to reverse, retracting the shuttle arm 190 away from the containers loaded on table 82.

The pressure plate of the mixing station is thereafter lowered, clamping the containers in preparation for a mixing operation. Thereafter, clamping is released and motor 144 is again energized, moving shuttle arm 190 to the position illustrated in phantom in FIG. 8, with projection 210 triggering sensor 206 to send signals to control unit 196, indicating that the ejection operation has been completed, and that the shuttle arm should be returned in an opposite direction to its retracted position.

Conveyor 14, as mentioned, is power driven, to move containers in the direction of arrow 214. As the two containers 18 are pushed onto conveyor 14, the leading container is free to move in the downstream direction of arrow 214. With the retraction of shuttle arm 190, contact member 192 is moved away from conveyor 14, and the second container 18 is also free to move in a downstream direction, at a position spaced from the leading container, as illustrated in FIG. 8.

Those skilled in the art will readily appreciate that four containers may easily be loaded at a mixing station in accordance with the present invention, as explained above. The guide walls 60, 62 can be moved toward one another to widen the product paths to allow pairs of containers 18 to pass side-by-side. With the arrival of a second pair of containers at entrance conveyors 38 or 40, the shuttle arms are moved to push four containers at a time onto tables 82, 84. It is preferred, in this alternative embodiment, that a pair of contact members 161 or 192 be carried at the ends of the shuttle arms, to form a W-configuration (rather than the aforedescribed V-shaped configuration) for pushing pairs of containers arranged side-by-side, at one time.

As can be seen from the above, two mixing mechanisms are provided to increase the throughput of the mixing station, without significantly increasing the amount of floor space required for the installation. Such an arrangement has been found to provide a significant production increase when production would otherwise be limited by the operating cycle of the mixing mechanisms employed. Diverter 44 directs one or more containers to a mixing mechanism, and both mixing mechanisms can be operated simultaneously to improve the overall operating cycle.

Further advantages can also be realized by the present invention. For example, a single lidding station can accommodate container ingredients of different types, requiring different mixing times or different mixing motions, for example. The containers with the differing ingredients can be interlaced on the inlet conveyor, the diverter 44 directing containers with ingredients of a particular type to the appropriate mixing mechanism. That is, the mixing mechanisms of the two product paths need not be identical, but can vary in operating time, direction of mixing motion, or other construction details.

For example, the mixing station may be called upon to mixing an epoxy paint or other two-part formulation, with the containers on exit conveyor 14 being associated in pairs, ready of packaging and shipment. Containers with the "Part A" ingredients can be passed along one product path to be mixed in a first mixing mechanism, with the "Part B" ingredients being mixed in the other mechanism, substantially simultaneously therewith. When the mixing operations are completed, the two containers are discharged onto conveyor 14.

If it is desired to closely group the two containers of a pair, the container in mixing mechanism 20 can be held briefly, while the container in mixing mechanism 22 is discharged by output surface 72 onto exit conveyor 14. As the container approaches the output support surface 70, the container in mechanism 20 is released for discharge onto conveyor 14, in close proximity to the container discharge for mechanism 22.

Further flexibility of operation is also possible. For example, the container discharged from mechanism 84 can be allowed to travel past output support surface 70 before the container in mechanism 20 is discharged onto conveyor 14, the order of the containers being reversed for presentation to a downstream packaging station. The flexibility of the automatic mixing apparatus according to the present invention is particularly important where the ingredients of one part of a two-part mixture contain a filler or other additive which is more difficult to mix, possibly requiring longer mixing times.

As will now be appreciated, appropriate mixing mechanisms can be installed in the various product paths and the timing of the various conveyors can be adjusted accordingly to accommodate different handling in the product paths. Further flexibility is also possible if scanning apparatus such as bar code reading apparatus is provided in each product path, for example, at the entrance conveyors 38, 40.

As mentioned above, different formulations can be interleaved at the entrance conveyor 12 with diverter gate 46 being operated to alternately direct containers to one or the other mixing mechanism. With additional scanning apparatus at each mixing mechanism, the containers can be interleaved in a random fashion on inlet conveyor 12, and can pass to the mixing mechanisms without delay. Upon loading the mixing mechanism, scanning apparatus can identify a particular paint formulation and can forward the information contained on the bar code label, for example, to the mixing mechanism to specify a custom mixing intensity or duration, for example. The bar code information could also be passed to a downstream packaging station or downstream diverter apparatus which could segregate formulations of a particular type.

As has been described above, mixing apparatus according to the present invention is particularly advantageous in maximizing the throughput of an automated mixing station. If an optimum throughput rate is not required, scanning apparatus can be installed along inlet conveyor 12, directing the diverter gate 46 to a particular mixing mechanism, depending upon information carried on the container.

Those skilled in the art will readily appreciate that alternative arrangements are possible with the present invention. For example, although both mixing mechanisms are discharged to a common exit conveyor 14, it should be understood that each mixing mechanism can be discharged to its own separate exit conveyor if such is useful from a product handling standpoint. Further, whereas orbital mixers have been described above, and are preferred for their ready availability and reliability of operation, other types of mixing mechanisms could also be employed.

As described above, the shuttle arms 160, 190 are pivotably retractable, being deflected by a travelling container moving therepast. If desired, the shuttle arms can be moved even further upstream, out of contact with containers travelling along the diverging guide walls 50 or 52, and the arms need not be retractable in that instance.

Whereas only a single diverter gate has been shown in the Preferred Embodiment, those skilled in the art will readily appreciate that similar diverter gates can be installed along each product path and such is preferred when mixing two or four containers at a time. For example, a diverter gate is installed in each entrance conveyor 38, 40, the conveyors being widened to accept two containers, side-by-side, at one time. In order to align the two containers in a side-by-side fashion, a diverter gate at the entrance conveyors 38, 40 can pair successive containers in the desired manner and can provide reliable operation without significantly increasing the cost or size of the mixing station.

As can be seen from the above, mixing apparatus constructed according to principles of the present invention can be fully automated and is readily incorporated in fully automated paint manufacturing equipment, such as that provided by the assignee of the present invention, as described above.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. An automated apparatus for mixing ingredients stored in closed containers, comprising:

an input support surface for receiving a series of containers from an inlet conveyor;

an output support surface for discharging containers to an exit conveyor;

at least two processing lanes between the input and output support surface for transporting containers therebetween;

lane guide means between said input support surface and said processing lanes, selectably movable to selectably guide containers carried by said input support surface to a particular processing lane for mixing thereat;

at least one mixing station in each processing lane, each mixing station including a frame means for movably supporting a container for movement in a mixing motion, container clamping means for selectably clamping the container within said frame means to maintain engagement therewith during a mixing operation, and drive means for moving said frame means with a mixing motion so as to agitate the contents of a container clamped therein; and loading means in each processing lane for loading a container guided by said lane guide means in the frame means, said loading means comprising, for each processing lane, an arm with a container-contacting surface carried on a shuttle means which moves back and forth along the lane, toward and away from the mixing station.

2. The apparatus of claim 1 wherein said shuttle means comprises a guide rail extending along the lane and a shuttle body mounted for reciprocal movement along said guide rail.

3. The apparatus of claim 2 wherein said shuttle means further comprises lead screw means extending along said guide rail and threadably engaged with said shuttle body, and rotating means for rotating said lead screw means.

4. The apparatus of claim 3 wherein said shuttle means further comprises a plurality of position sensors extending along said lane with means for sending an electrical output signal indicating the presence of the shuttle arm and hence a container moved thereby, control means coupled to said position sensors and to said rotating means to control the movement and position of the shuttle arm.

5. The apparatus of claim 1 wherein said arm is pivotally mounted on said shuttle body so as to be retracted out of the path of travel of a container moving therepast.

6. The apparatus of claim 1 further comprising ejecting means for ejecting a container from said mixing station to said output support surface.

7. The apparatus of claim 6 wherein said ejecting means comprises means for selectably moving said arm adjacent said output support surface so as to eject a container from a mixing station when a mixing operation is completed.

8. The apparatus of claim 3 further comprising positioning means for positioning a container with respect to the frame means of a mixing station, comprising a position sensor located adjacent said processing lane for sensing that the shuttle means is at a position whereat the shuttle arm is located adjacent the frame means, said position sensor having means for sending an electrical output signal indicating the desired positioning of the shuttle arm and hence a container moved thereby, control means coupled to said position sensor and to said rotating means to stop the movement of the shuttle arm.

9. The apparatus of claim 8 further comprising ejecting means for ejecting a container from the frame means of a mixing station to the output support surface, comprising a second position sensor located adjacent said processing lane for sensing that the shuttle means is at a position whereat the shuttle arm is located adjacent output support surface, said second position sensor having means coupled to the control means for sending an electrical output signal indicative of the shuttle arm and hence a container moved thereby, said control means responding thereto to reverse the movement of the shuttle arm to prepare for a subsequent cycle of operation.

10. The apparatus of claim 1 wherein said input support surface and said processing lanes include power-driven roller means for moving containers in a downstream direction toward said output support surface, and said lane guide means comprises a diverter gate pivotally mounted for movement between first and second positions, each for directing a container moving therepast to a respective mixing station.

11. The apparatus of claim 10 wherein said processing lanes include a stationary container supporting section upstream of the frame means to align a container for engagement with said loading means.

12. An automated apparatus for use in an automated production facility to mix ingredients stored in a series of closed containers, comprising:

inlet conveyor means;

an input support surface for receiving a series of containers from inlet conveyor means;

outlet conveyor means;

an output support surface for discharging containers to the outlet conveyor means;

at least two processing lanes between the input and output support surfaces for transporting containers therebetween;

lane guide means between said input support surface and said processing lanes, selectably movable to selectably guide containers carried by said input support surface to a particular processing lane for mixing thereat;

at least one mixing station in each processing lane, each mixing station including a frame means for movably supporting a container for movement in a mixing motion, container clamping means for selectably clamping the container within said frame means to maintain engagement therewith during a mixing operation, and drive means for moving said frame means with a mixing motion so as to agitate the contents of a container clamped therein; and loading means in each processing lane for loading a container guided by said lane guide means in the frame means, said loading means comprising, for each processing lane, an arm with a container-contacting surface carried on a shuttle means which moves back and forth along the lane, toward and away from the mixing station, and said shuttle means comprises a guide rail extending along the lane and a shuttle body mounted for reciprocal movement along said guide rail, and wherein said arm is pivotally mounted on said shuttle body so as to be retracted out of the path of travel of a container moving therepast.

13. The apparatus of claim 12 wherein said shuttle means further comprises lead screw means extending along said guide rail and threadably engaged with said shuttle body, and rotating means for rotating said lead screw means.

14. The apparatus of claim 13 wherein said shuttle means further comprises a plurality of position sensors extending along said lane with means for sending an electrical output signal indicating the presence of the shuttle arm and hence a container moved thereby, control means coupled to said position sensors and to said rotating means to control the movement and position of the shuttle arm.

15. The apparatus of claim 13 further comprising ejecting means for ejecting a container from said mixing station to said output support surface, comprising means for selectably moving said arm adjacent said output support surface so as to eject a container from a mixing station when a mixing operation is completed.

16. The apparatus of claim 12 wherein said input support surface and said processing lanes include power-driven roller means for moving containers in a downstream direction toward said output support surface, and said lane guide means comprises a diverter gate pivotally mounted for movement between first and second positions, each for directing a container moving therepast to a respective mixing station.

17. The apparatus of claim 16 wherein said processing lanes include a stationary container supporting section upstream of the frame means to align a container for engagement with said loading means.

18. An automated apparatus for use in an automated production facility to mix ingredients stored in a series of closed containers, comprising:

inlet conveyor means;

lane guide means;

an input support surface for receiving a series of containers from inlet conveyor means, comprising a single lane for conveying closed containers to said lane guide means;

outlet conveyor means;

an output support surface for discharging containers to the outlet conveyor means;

two processing lanes between the input and output support surfaces for transporting containers therebetween;

said lane guide means located between said input support surface and said processing lanes, and selectably movable to selectably guide containers carried by said input support surface to a particular processing lane for mixing thereat, said lane guide means comprising a generally planar diverter gate having an upstream free end and a downstream end which is pivotally mounted for movement between first and second positions, each for directing a container to a respective mixing station, means for moving the diverter gate between the first and second positions and a diverging guide wall located immediately downstream of said diverter gate downstream end and cooperating with said diverter gate when said diverter gate is in said first and second positions so as to form first and second guide surfaces along which containers are guided to said two processing lanes;

at least one mixing station in each processing lane, each mixing station including a frame means for movably supporting a container for movement in a mixing motion, container clamping means for selectably clamping the container within said frame means to maintain engagement therewith during a mixing operation, and drive means for moving said frame means with a mixing motion so as to agitate the contents of a container clamped therein; and loading means in each processing lane for loading a container guided by said lane guide means in the frame means, said loading means comprising, for each processing lane, an arm with a container-contacting surface carried on a shuttle means which moves back and forth along the lane, toward and away from the mixing station, and said shuttle means comprises a guide rail extending along the lane and a shuttle body mounted for reciprocal movement along said guide rail, and wherein said arm is pivotally mounted on said shuttle body so as to be retracted out of the path of travel of a container moving therepast.

* * * * *